US005503196A

United States Patent [19]

Josef et al.

[11] Patent Number: 5,503,196

[45] Date of Patent: Apr. 2, 1996

[54] PAPERMAKERS FABRIC HAVING A SYSTEM OF MACHINE-DIRECTION YARNS RESIDING INTERIOR OF THE FABRIC SURFACES

[75] Inventors: Michael J. Josef, Greenville, S.C.; Eric R. Romanski, Delmar; Ross G. Burbank, Clifton Park, both of N.Y.

[73] Assignee: Albany International Corp., Albany, N.Y.

[21] Appl. No.: 350,831

[22] Filed: Dec. 7, 1994

[51] Int. Cl.[6] ..... D03D 13/00; D03D 15/00

[52] U.S. Cl. ..... 139/383 A; 139/383 AA; 139/408

[58] Field of Search ..... 139/383 A, 425 A, 139/408, 413, 383 AA

[56] References Cited

U.S. PATENT DOCUMENTS

| | | | |
|---|---|---|---|
| 2,864,409 | 12/1958 | Richter | 139/408 |
| 4,290,209 | 9/1981 | Buchanan et al. . | |
| 4,403,632 | 9/1983 | Romanski et al. | 139/383 AA X |
| 4,438,788 | 3/1984 | Harwood | 139/408 X |
| 4,469,142 | 9/1984 | Harwood | 139/425 A X |
| 4,621,663 | 11/1986 | Malmandier . | |
| 4,749,007 | 6/1988 | Malmendier | 139/383 A |
| 4,829,681 | 5/1989 | Josef . | |
| 4,883,702 | 11/1989 | Sato et al. | 428/141 |
| 5,023,132 | 6/1991 | Stanley et al. | 139/383 A |
| 5,050,646 | 9/1991 | Fry | 139/408 X |
| 5,103,874 | 4/1992 | Lee . | |
| 5,114,777 | 5/1992 | Gaisser . | |
| 5,117,865 | 6/1992 | Lee . | |
| 5,151,316 | 9/1992 | Durkin et al. | 139/383 A |
| 5,199,467 | 4/1993 | Lee . | |
| 5,238,027 | 8/1993 | Lee . | |
| 5,358,014 | 10/1994 | Kovar | 139/383 A |
| 5,364,331 | 11/1994 | Higashino et al. | 492/43 |

*Primary Examiner*—Andy Falik

*Attorney, Agent, or Firm*—Kane, Dalsimer, Sullivan, Kurucz, Levy, Eisele & Richard

[57] ABSTRACT

A papermaker's fabric having a smooth surface and a prolonged life includes flat machine-direction yarns which define the upper and lower surfaces thereof. The fabric has two layers of cross-machine direction yarns, each of which is interwoven with the flat machine-direction yarns. Other machine-direction yarns, of round cross section, weave with the cross-machine-direction yarns in the two layers to bind the two layers together. The knuckles of these round machine-direction yarns are within the fabric with respect to the planes defined by the flat machine-direction yarns, and, as a consequence, are less susceptible to degradation by heat and abrasion. The round machine-direction yarns may be used to seam the fabric. A longer fabric life follows from the protection of the round machine-direction yarns by the flat. The papermaker's fabric is particularly useful as a dryer fabric on the dryer section of a papermachine.

34 Claims, 4 Drawing Sheets

PAPERMAKERS FABRIC HAVING A SYSTEM OF MACHINE-DIRECTION YARNS RESIDING INTERIOR OF THE FABRIC SURFACES

BACKGROUND OF THE INVENTION

1. Field of the Invention

The present invention relates to the papermaking arts. More specifically, the present invention is a papermaker's fabric for use on the dryer section of the papermachine, such a fabric being commonly referred to as a dryer fabric.

2. Description of the Prior Art

During the papermaking process, a fibrous web is formed by depositing a fibrous slurry on a forming fabric in the forming section of a papermachine. A large amount of water drains from the slurry through the forming fabric during this process, leaving the fibrous web on the surface of the forming fabric.

The newly formed web proceeds from the forming section to a press section, which includes a series of press nips. The fibrous web passes through the press nips supported by a press fabric, or, as is often the case, between two such press fabrics. In the press nips, the fibrous web is subjected to compressive forces which squeeze water therefrom. This water is accepted by the press fabric or fabrics and, ideally, does not return to the web.

The web finally proceeds to a dryer section, which includes at least one series of rotatable dryer drums or cylinders, heated from within by steam. The web is directed in a sinuous path sequentially around each in the series of drums by one or more dryer fabrics, which hold the web closely against the surfaces of the drums. The heated drums reduce the water content of the web to a desirable level through evaporation.

The surface characteristics of the fabrics used in the forming and press sections of the papermachine have a direct bearing on the surface properties of the paper being produced. This is also true in the dryer section, where, as stated above, the dryer fabric holds the web closely against the surfaces of the heated dryer cylinders. To promote drying efficiency by increasing the surface area of the dryer fabric directly in contact with the web, and to reduce the marking of the web by the fabric, the dryer fabrics are typically woven to have surfaces which are as smooth as possible. In recent years, one approach that has been taken to provide dryer fabrics with such surfaces has been to include flat monofilament yarns in their woven structures.

While it is indeed clear that the inclusion of flat monofilament yarns on the paper-contacting surfaces of a dryer fabric increases the contact surface area between fabric and dryer cylinder, and therefore between web and dryer cylinder, such fabrics have been observed to be susceptible to wrinkling both during in-house processing and after installation on the dryer section of a papermachine. This is particularly the case when flat monofilament yarns are next, or contiguous, to one another on the surface of the dryer fabric.

Further, where the flat monofilament surface yarns are used to form seaming loops, the dryer fabrics have unacceptably short lives on the papermachine because of the heat and abrasion to which the surface yarns are exposed in the drying section.

For example, U.S. Pat. No. 4,290,209 shows a dryer fabric woven entirely from monofilament plastic polymeric warp and weft strands, wherein at least the warp strands are flattened in cross-section with the long axis of the flattened section extending parallel to the plane of the fabric. The warp strands extend in the machine direction of the fabric, and are provided in an approximately 100% warp fill, which implies that the warp strands are woven contiguously. The fabric does not include a separate system of machine-direction warp yarns, interior of the surface planes formed by the flat yarns, for use in seaming.

U.S. Pat. No. 4,621,663, and related U.S. Pat. No. 4,749,007, show a fabric for draining and drying paper webs. The fabric is formed by warp threads and weft threads, and further comprises a top layer of interlaced lengthwise strips and weft threads. The lengthwise strips are side-by-side one another. The fabric does not include a separate system of machine-direction warp yarns, protected within the interior of the fabric, for use in seaming.

U.S. Pat. No. 5,103,874, and related U.S. Pat. Nos. 5,117,865; 5,199,467; and 5,238,027, show a papermaker's fabric having a system of flat monofilament machine-direction yarns. The system of machine-direction yarns comprises upper and lower yarns which are vertically stacked. At least the upper machine-direction yarns are flat monofilament yarns woven contiguously with each other to reduce the permeability of the fabric and to lock in the machine-direction alignment of the stacking pairs of machine-direction yarns. A seam for the fabric comprised of loops formed from selected flat machine-direction yarns is provided to render the fabric endless during use in papermaking. The fabric does not include a separate system of machine-direction warp yarns, interior of the surface planes of the fabric, for use in seaming.

The present invention is a dryer fabric which may include flat monofilament yarns, but which is woven in a manner that leaves it less susceptible to the above-noted deficiencies of prior-art fabrics. The flat monofilament yarns are not woven contiguously and are not used to form seaming loops. Instead, a separate system of machine-direction warp yarns, interior of the surface planes of the fabric, is provided for use in seaming.

SUMMARY OF THE INVENTION

Accordingly, the present invention is a dryer fabric, although it may find application in any of the forming, press and dryer sections of a papermachine.

As such, the present invention is a papermaker's fabric for the forming, press and dryer sections of a papermachine. The fabric includes a first layer and a second layer of cross-machine-direction (CD) yarns. Interwoven with the CD yarns are a first system of machine-direction (MD) yarns and a second system of MD yarns.

The MD yarns in the first system of MD yarns are interwoven with the CD yarns in the first and second layers in a duplex weave and bind the first and second layers together.

The MD yarns in the second system weave with the CD yarns in either the first or the second layers. Specifically, some of the MD yarns in the second system weave with the CD yarns in the first layer, while the remainder of the MD yarns in the second system weave with the CD yarns in the second layer.

The MD yarns in the second system define the upper and lower surfaces of the fabric, and may be flat yarns having a substantially rectangular cross section. On the other hand, the MD yarns of the first system reside within the fabric with respect to its upper and lower surfaces. In other words, the knuckles formed where the MD yarns of the first system weave over (or under) the CD yarns of the first (or second) layer are interior of the surface planes formed by the MD yarns of the second system.

In a preferred embodiment, the CD yarns of the first layer are in a vertically stacked, paired relationship with the CD yarns of the second layer. Further, the MD yarns of the second system are in a vertically stacked, paired relationship with one another. That is to say, those MD yarns of the second system weaving with the CD yarns of the first layer are vertically stacked over those MD yarns of the second system weaving with the CD yarns of the second layer with which they are paired. Finally, a pair of MD yarns of the first system are between each stacked pair of MD yarns of the second system. As such, pairs of MD yarns in the first system alternate with vertically stacked pairs of MD yarns of the second system widthwise across the fabric.

The present invention will now be described in more complete detail with frequent reference being made to the drawing figures, which are identified above.

DETAILED DESCRIPTION OF THE PREFERRED EMBODIMENTS

Figure 1:
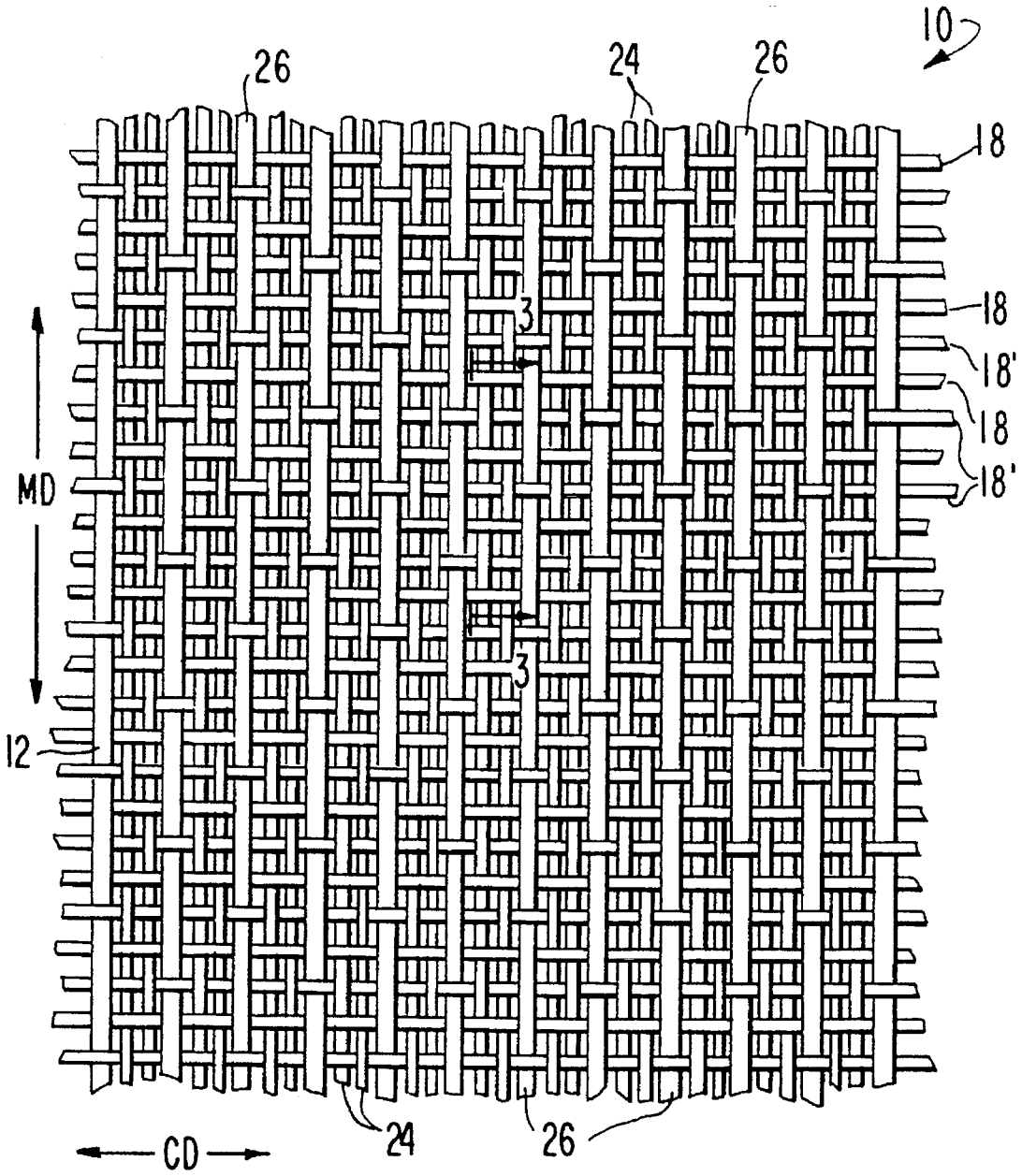
FIG. 1 is a plan view of the upper surface of the papermaker's fabric of the present invention.

With reference now to the figures, FIG. 1 is a plan view of the upper surface 12 of the papermaker's fabric 10 of the present invention. In FIG. 1, the machine direction (MD) and cross-machine direction (CD) are as indicated. While only the upper surface 12 is visible, it will be apparent from the description to follow that the lower surface 14 will have a similar appearance. The spacing between the yarns of the papermaker's fabric 10 in this and other figures is exaggerated for the sake of clarity.

Figure 2:
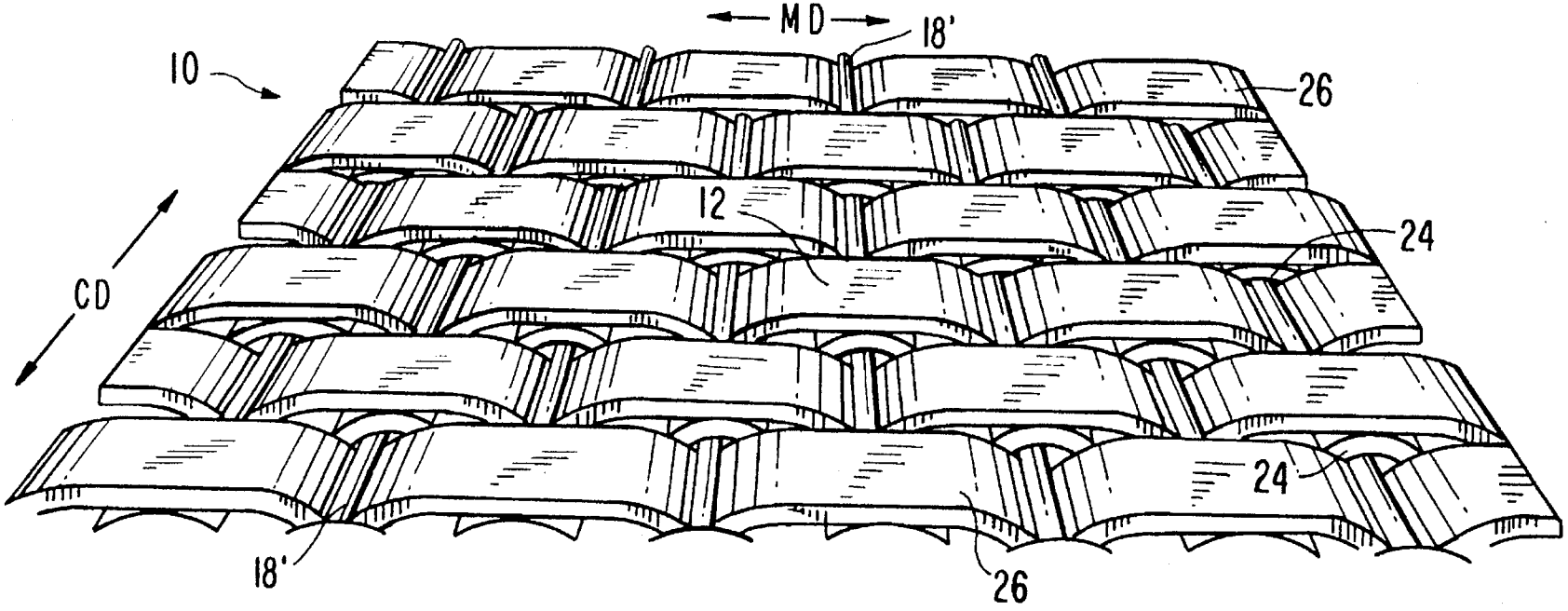
FIG. 2 is a perspective view of the upper surface of the papermaker's fabric.

FIG. 2 is a perspective view of the upper surface 12 of the papermaker's fabric 10, showing a more realistic spacing between adjacent yarns of the fabric.

Figure 3:
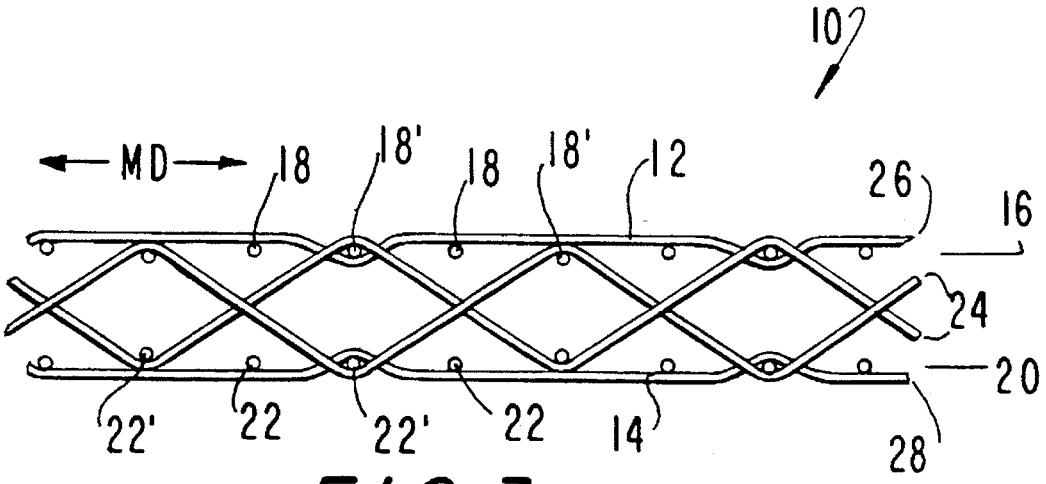
FIG. 3 is a cross-sectional view, taken in the machine direction as indicated by line 2—2 in FIG. 1, of the papermaker's fabric.

FIG. 3 is a cross-sectional view, taken as indicated by line 2—2 in FIG. 1. It will be noted that fabric 10 includes two layers of CD yarns. A first layer 16 of CD yarns 18,18' is on the upper side of fabric 10, while a second layer 20, not visible in FIG. 1, of CD yarns 22,22' is on the lower side. It will be noted that CD yarns 18',22' are bound by MD yarns 24, while CD yarns 18,22 are not so bound. CD yarns 18,18' and CD yarns 22,22' may be provided in equal numbers, and, if so provided, may be in the vertically stacked, paired relationship shown in FIG. 3. That is to say, CD yarns 18,18' may be paired with and vertically stacked over CD yarns 22,22', respectively. Further, CD yarns 18,18',22,22' may be monofilament, multifilament or plied monofilament yarns of any of the synthetic polymeric resins used in the production of such yarns for papermachine clothing. Polyester and polyamide are but two examples of such materials. Other examples of such materials are yarns of polyphenylene sulfide (PPS), which is commercially available under the name RYTON®, and yarns of a modified heat-, hydrolysis- and contaminant-resistant polyester of the variety disclosed in commonly assigned U.S. Pat. No. 5,169,499, and used in dryer fabrics sold by Albany International Corp. under the trademark THERMONETICS®. U.S. Pat. No. 5,169,499 is incorporated herein by reference.

Finally, CD yarns 18,18',22,22' may be of uniform thickness, or may be of more than one thickness. For example, CD yarns 18',22' which are bound by MD yarns 24 may be thinner than those which are not so bound, CD yarns 18,22.

CD yarns 18',22' are interwoven by a first system of MD yarns 24. MD yarns 24 are monofilament yarns of either circular or rectangular cross section, although circular cross section yarns are preferred. As above, MD yarns 24 may be of any of the synthetic polymeric resins used in the production of yarns for papermachine clothing. Polyester and polyamide are but two examples, along with the polyphenylene sulfide and modified heat-, hydrolysis- and contaminant-resistant polyester yarns described above.

MD yarns 24 interweave with CD yarns 18',22' in a duplex pattern, such as that shown in FIG. 3. A duplex pattern is one in which multiple layers of filling yarns are interwoven with a single system of warp yarns. A MD yarn 24, for example, may weave over one CD yarn 18', between the next vertically stacked pair of CD yarns 18,22 under the next CD yarn 22', between the next vertically stacked pair of CD yarns 18,22, and over the next CD yarn 18' to repeat the pattern.

The MD yarns in a second system of MD yarns may be either thinner or thicker than MD yarns 24 of the first system, or they may be equal in thickness to MD yarns 24. The second system of MD yarns comprises MD yarns 26 and MD yarns 28.

MD yarns 26,28 are monofilament yarns of either circular or rectangular cross section, although those of rectangular cross section are preferred. As before, MD yarns 26,28 may be of any of the synthetic polymeric resins used in the production of yarns for papermachine clothing. Polyester and polyamide are again but two examples, along with the polyphenylene sulfide and modified heat-, hydrolysis- and contaminant-resistant polyester yarns described above.

Figure 4:
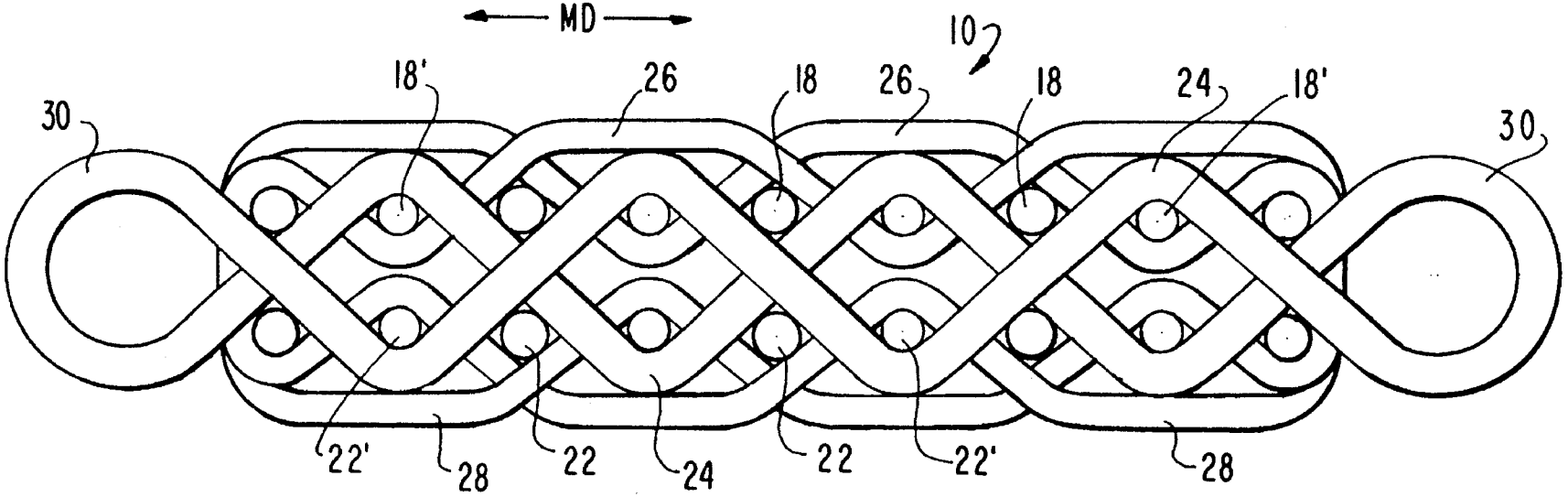
FIG. 4 is a cross-sectional view, similar to that shown in FIG. 3, illustrating the manner in which the papermaker's fabric may be seamed.

MD yarns 26 interweave with CD yarns 18,18' to form the upper surface 12 of the fabric 10, while MD yarns 28 interweave with CD yarns 22,22' to form the lower surface 14 of the fabric 10. The knuckles formed when MD yarns 24 interweave with CD yarns 18',22' are within the surface planes defined by MD yarns 26,28, when the weave pattern shown in the figures is used. MD yarns 24 are thereby protected from degradation by heat and abrasion, and may be used to seam the fabric 10 into endless form by either pin or spiral seaming, as shown in FIG. 4. A fabric 10 having a prolonged useful life may thereby be obtained. MD yarns 26,28 may be either thicker or thinner than MD yarns 24, or they may be equal in thickness to MD yarns 24.

Preferably, MD yarns 24,26,28 are contamination- and heat-resistant yarns.

MD yarns 26 are interwoven with CD yarns 18,18', and MD yarns 28 are interwoven with CD yarns 22,22', to give the fabric 10 smooth upper and lower surfaces 12,14. MD yarns 26 may weave over three consecutive CD yarns 18,18',18, under the next CD yarn 18', and then over the next three consecutive CD yarns 18,18',18 to follow a repeating pattern. Similarly, MD yarns 28 may weave under three consecutive CD yarns 22,22',22, over the next CD yarn 22', and then under the next three consecutive CD yarns 22,22', 22 to follow a repeating pattern. MD yarns 24 weave over the CD yarns 18' under which MD yarns 26 weave. Similarly, MD yarns 24 weave under the CD yarns 22' over which MD yarns 28 weave.

MD yarns 26,28 may also be in a vertically stacked, paired relationship, as shown in FIG. 3 and suggested by FIG. 1. Such stacked pairs, however, will not be contiguous with, or adjacent to, one another, as they will be separated by at least one MD yarn 24 binding the first and second layers 16,20 together. Preferably, two MD yarns 24 are between each stacked pair of MD yarns 26,28.

Because stacked pairs of MD yarns 26,28 are not contiguous with, or adjacent to, one another, and because the knuckles formed when MD yarns 24 interweave with CD yarns 18',22' are within the surface planes defined by MD yarns 26,28, lengthwise channels are defined by, and are disposed between, MD yarns 26,28 on the upper and lower surfaces 12,14 of the fabric 10. The lengthwise channels are conducive to the handling of air on a papermaking machine in their ability to channel it lengthwise therethrough and by providing void space for air to enter when the fabric 10 encounters and passes around a roll or cylinder on the machine.

Referring again to FIG. 4, an exaggeratedly short papermaker's fabric 10 is shown in cross section to illustrate the manner in which it might be seamed into endless form. MD yarns 24 may form loops 30 at the opposite lengthwise ends of the papermaker's fabric 10. The papermaker's fabric 10 may then be seamed into endless form by bringing the two ends of the fabric 10 together and by interdigitating the loops 30, thereby defining a more-or-less cylindrical passage or tunnel through which a seaming pin or pintle may be directed to join the ends together.

The following is an example of a preferred embodiment of the present invention. It is provided for purposes of illustration and should not be taken to limit the subject matter claimed in the appended claims in any way.

EXAMPLE

A papermaker's fabric 10 was woven according to the weave pattern shown in FIGS. 1 through 4 and described above. MD yarns 26,28 were flat monofilament yarns of substantially rectangular cross section of dimensions 0.30 mm thick by 1.20 mm wide (0.012 inch by 0.047 inch; 12 mil by 47 mil), the width being on the upper and lower surfaces 12,14 of the fabric 10. MD yarns 24 were monofilament yarns of circular cross section of diameter 0.50 mm (0.020 inch; 20 mil). It will be noted that MD yarns 24 were thicker than MD yarns 26,28. Nevertheless, as a consequence of the weave pattern used and illustrated herein, the knuckles formed where MD yarns 24 wrap over (or under) CD yarns 18',22' are within the surface planes defined by MD yarns 26,28.

CD yarns 18,22 were monofilament yarns of circular cross section of diameter 0.50 mm (0.020 inch; 20 mil), while CD yarns 18',22' were monofilament yarns of circular cross section of diameter 0.40 mm (0.016 inch; 16 mil). CD yarns 18,18' alternate with one another, and, likewise, CD yarns 22,22' alternate with one another. CD yarns 18 were paired with and vertically stacked over CD yarns 22; in like manner, CD yarns 18' were paired with and vertically stacked over CD yarns 22'. MD yarns 24 binded with CD yarns 18',22'.

The papermaker's fabric 10 of this example performed with good results when tested on the dryer section of a papermaking machine.

Modifications to the above would be obvious to those of ordinary skill in the art, but would not bring the invention so modified beyond the scope of the appended claims.

What is claimed is:

1. A papermaker's fabric for the forming, press and dryer sections of a papermachine comprising:

a first layer and a second layer of cross-machine direction (CD) yarns;

a first system of machine-direction (MD) yarns, said MD yarns of said first system being interwoven with selected CD yarns of said first and second layers in a duplex weave to bind said first and second layers together; and a second system of MD yarns, some of said MD yarns in said second system being interwoven with said CD yarns of said first layer and the remainder of said MD yarns in said second system being interwoven with said CD yarns of said second layer, said MD yarns of said second system forming an upper and a lower surface of said fabric, and said MD yarns of said first system, and knuckles formed by the interweaving of said MD yarns with said selected CD yarns of said first and second layers, residing within said fabric with respect to said upper surface and said lower surface, whereby said MD yarns of said first system may be protected from abrasion.

2. A papermaker's fabric as claimed in claim 1 wherein at least some of said CD yarns are polyamide yarns.

3. A papermaker's fabric as claimed in claim 1 wherein at least some of said CD yarns are polyester yarns.

4. A papermaker's fabric as claimed in claim 1 wherein at least some of said CD yarns are polyphenylene sulfide yarns.

5. A papermaker's fabric as claimed in claim 1 wherein at least some of said CD yarns are modified heat- and hydrolysis-resistant polyester yarns.

6. A papermaker's fabric as claimed in claim 1 wherein at least some of said CD yarns are monofilament yarns.

7. A papermaker's fabric as claimed in claim 1 wherein at least some of said CD yarns are multifilament yarns.

8. A papermaker's fabric as claimed in claim 1 wherein at least some of said CD yarns are plied monofilament yarns.

9. A papermaker's fabric as claimed in claim 1 wherein there is one CD yarn in said first layer for every CD yarn in said second layer.

10. A papermaker's fabric as claimed in claim 9 wherein said CD yarns in said first layer are in a vertically stacked relationship with said CD yarns in said second layer, thereby forming stacked pairs.

11. A papermaker's fabric as claimed in claim 1 wherein said MD yarns in said first system are of circular cross section.

12. A papermaker's fabric as claimed in claim 1 wherein said MD yarns in said first system are of rectangular cross section.

13. A papermaker's fabric as claimed in claim 1 wherein said MD yarns in said first system are monofilament yarns.

14. A papermaker's fabric as claimed in claim 1 wherein at least some of said MD yarns in said first system are polyamide yarns.

15. A papermaker's fabric as claimed in claim 1 wherein at least some of said MD yarns in said first system are polyester yarns.

16. A papermaker's fabric as claimed in claim 1 wherein at least some of said MD yarns in said first system are polyphenylene sulfide yarns.

17. A papermaker's fabric as claimed in claim 1 wherein at least some of said MD yarns in said first system are modified heat- and hydrolysis-resistant polyester yarns.

18. A papermaker's fabric as claimed in claim 10 wherein each of said MD yarns in said first system weaves in a repeating pattern over a CD yarn in said first layer, between the next stacked pair of said CD yarns, under the next CD yarn in said second layer, between the next stacked pair of said CD yarns, and over the next CD yarn in said first layer to repeat said pattern.

19. A papermaker's fabric as claimed in claim 1 wherein said MD yarns of said second system are of circular cross section.

20. A papermaker's fabric as claimed in claim 1 wherein said MD yarns of said second system are of rectangular cross section.

21. A papermaker's fabric as claimed in claim 1 wherein said MD yarns of said second system are monofilament yarns.

22. A papermaker's fabric as claimed in claim 1 wherein at least some of said MD yarns of said second system are polyamide yarns.

23. A papermaker's fabric as claimed in claim 1 wherein said MD yarns of said second system are polyester yarns.

24. A papermaker's fabric as claimed in claim 1 wherein at least some of said MD yarns in said second system are polyphenylene sulfide yarns.

25. A papermaker's fabric as claimed in claim 1 wherein at least some of said MD yarns in said second system are modified heat- and hydrolysis-resistant polyester yarns.

26. A papermaker's fabric as claimed in claim 1 wherein each of said MD yarns in said second system interwoven with said CD yarns in said first layer weaves in a repeating pattern over three consecutive CD yarns in said first layer, under the next CD yarn in said first layer, and over the next three consecutive CD yarns in said first layer to repeat said pattern.

27. A papermaker's fabric as claimed in claim 1 wherein each of said MD yarns in said second system interwoven with said CD yarns in said second layer weaves in a repeating pattern over a CD yarn in said second layer, under the next three consecutive CD yarns in said second layer, and over the next CD yarn in said second layer to repeat said pattern.

28. A papermaker's fabric as claimed in claim 1 wherein said MD yarns in said second system of MD yarns are in vertically stacked pairs, one MD yarn in each of said pairs being interwoven with said CD yarns in said first layer, and the other MD yarn in each of said pairs being interwoven with said CD yarns in said second layer.

29. A papermaker's fabric as claimed in claim 28 wherein there are two MD yarns of said first system of MD yarns between each vertically stacked pair of said MD yarns of said second system of MD yarns.

30. A papermaker's fabric as claimed in claim 1 wherein said MD yarns of said second system are thicker than said MD yarns of said first system.

31. A papermaker's fabric as claimed in claim 1 wherein said MD yarns of said second system are thinner than said MD yarns of said first system.

32. A papermaker's fabric as claimed in claim 1 wherein said MD yarns of said second system are of the same thickness as said MD yarns of said first system.

33. A papermaker's fabric as claimed in claim 1 wherein said MD yarns of said first system are monofilament yarns of circular cross section, and said MD yarns of said second system are monofilament yarns of rectangular cross section.

34. A papermaker's fabric as claimed in claim 1 wherein said MD yarns of said second system define lengthwise channels therebetween on said upper and lower surfaces of said fabric, because of said MD yarns of said first system interweaving with said selected CD yarns in said first layer below said upper surface of said fabric, and with said CD yarns in said second layer above said lower surface of said fabric.

* * * * *